United States Patent [19]

Kanehara et al.

[11] Patent Number: 5,026,972

[45] Date of Patent: Jun. 25, 1991

[54] AUTOMATIC TOLL RECEIVING APPARATUS

[75] Inventors: Koichi Kanehara; Kazumi Fukuda; Kouichi Uenishi, all of Kobe, Japan

[73] Assignee: Mitsubishi Jukogyo Kabushiki Kaisha, Tokyo, Japan

[21] Appl. No.: 472,339

[22] Filed: Jan. 26, 1990

[30] Foreign Application Priority Data

Feb. 9, 1989 [JP] Japan ..... 1-28576

[51] Int. Cl.[5] ..... G07B 15/00

[52] U.S. Cl. ..... 235/32; 235/100; 232/7; 232/44; 232/59

[58] Field of Search ..... 235/32, 33, 100; 232/7, 232/44, 55-57, 59, 61

[56] References Cited

U.S. PATENT DOCUMENTS

| | | | |
|---|---|---|---|
| 2,352,846 | 7/1944 | Marchioni et al. | 235/32 |
| 2,533,654 | 12/1950 | Wilcox et al. | 235/32 |
| 2,990,113 | 6/1961 | Fosbrink et al. | 232/44 X |
| 3,024,970 | 3/1962 | Powers | 232/44 |
| 3,791,574 | 2/1974 | Picquot | 232/44 |
| 3,836,069 | 9/1974 | Craig, Jr. | 232/44 X |

FOREIGN PATENT DOCUMENTS 2216321 10/1989 United Kingdom .

*Primary Examiner*—Benjamin R. Fuller

*Attorney, Agent, or Firm*—Toren, McGeady & Associates

[57] ABSTRACT

An improved automatic toll receiving apparatus of the throwing-in type installed so as to allow a driver sitting in an automotive vehicle to pay a specified rate of toll, which apparatus includes a large hopper into which the driver can easily throw coins, a determining mechanism for determining whether the received coins are true coins or false coins and discriminating the kind of coins, a counting unit for counting a value of the coins which are determined as true coins, a returning unit for returning to the driver the coins which are determined as false coins, a temporary coin holder for temporarily holding the coins at shortest for a period of time until a processing for the preceding vehicle is completed, so as to allow him to visually confirm the coins through a transparent side wall of the temporary coin holder by the driver while they are arranged side by side, and an actuator for rotating the partition of the temporary coil holder at the bottom thereof 45 degrees as to enable a processing for the next vehicle when it is confirmed by the counting unit that a value of the received coins matches with a specified rate of toll. By rotating the partition in that way, the coins in the temporary coin holder are displaced to another temporary coin holder and then they are discharged from the latter into a safe when a processing for the preceding vehicle is completed, the temporary coin holder being inclined downward and sideward so as to allow the coins to be slidably displaced therein.

2 Claims, 6 Drawing Sheets

(A)

(B)

AUTOMATIC TOLL RECEIVING APPARATUS

FIELD OF THE INVENTION AND RELATED ART STATEMENT

The present invention relates generally to an automatic toll receiving apparatus installed on a toll highway, a parking station or the like facility. More particularly, the present invention relates to an improvement of the throwing-in type automatic toll receiving apparatus including a large hopper into which coins are thrown by a driver seating on his seat in an automotive vehicle.

A visual temporary coin holding mechanism which has been heretofore employed for a conventional automatic toll receiving apparatus is typically classified into the following two types.

One of them is a divisional rotary disc type as shown in FIG. 3. This type of temporary coin holding mechanism is constructed such that a set of coins for one vehicle which have been discriminated by a coin selector (not shown) as true coins are introduced into and held in one division on a rotary disc and this rotary disc is then rotated by one-third revolution by a motor or the like means whenever a processing for the present vehicle is completed so that a division for receiving a set of true coins from a next vehicle and the division having the true coins thrown from the present vehicle are displaced to the coin selector side. For example, as shown in FIG. 3, a plurality of true coins are introduced into a holding division 25 for the present vehicle via a chute 21 on the housing 20 of the temporary coin holding mechanism. When a processing for the present vehicle has been completed, a partition 23 is rotated by one-third revolution by a motor 27 via an endless belt 28 so that coins 26 in a holding division 24 for the preceding vehicle reach a chute 22 which leads to a safe installed below the rotary disc. Thus, the coins 26 in the holding division 24 fall down into the safe.

After the coins 26 fall down in that way, the empty holding division is rotationally displaced to the position corresponding to the holding division 25 for the present vehicle. Thereafter, the above-described process is repeated.

The conventional mechanism as constructed in the above-described manner is simple in structure but it has drawbacks that coins are visually recognized with much difficulties due to their overlapping and these coins are held in each holding division regardless of an order of their introduction.

The other type of temporary coin holding mechanism is as shown in FIG. 4. As is apparent from the drawing, this temporary coin holding mechanism is snake-shaped passage type. Coins 30 for the preceding vehicle are held by a stopper 32 and coins 29 for the present vehicle are held by a stopper 32 in the passage. This type of temporary coin holding mechanism requires a certain period of time within which all coins thrown by a first driver are displaced to a holding region for the coins 30 corresponding to the preceding vehicle to receive coins to be paid by a next driver after payment is rendered by the first driver.

As will be apparent from the above description, the conventional coin receiving apparatuses has a problem that a driver can not visually confirm his thrown coins one by one and a long period of time is required until a second processing is undertaken after a first processing is completed.

OBJECT AND SUMMARY OF THE INVENTION

The present invention has been made with the foregoing problems in mind and its object resides in providing an automatic toll receiving apparatus which is simple in structure and designed and constructed in smaller dimensions.

To accomplish the above object, the present invention provides an automatic toll receiving apparatus of the throwing-in type installed on a toll highway, a parking station or the like facility so as to allow a driver seating on his seat in an automotive vehicle to pay a specified rate of toll, wherein the apparatus includes a large hopper into which coins can easily be thrown by him, determining means for determining whether the thrown coins are true coins or false coins, a counting unit for counting a value of the coins which are determined by the determining means as true coins, a returning unit for returning to him the coins which are determined by the determining means as false coins, first temporary coin holding means for temporarily holding the coins at shortest for a period of time until a processing for the preceding vehicle is completed, so as to allow him to visually confirm the coins through the transparent side wall of a passage while they are arranged in the passage side by side, the passage including a lower partition to support the coins which are introduced into the passage via a guiding course having the substantial same width as that of each coin, second temporary coin holding means for temporarily holding the coins which fall down from the first temporary coin holding means by rotating the lower partition so as to enable a processing for a next vehicle to be undertaken when it is found that the value of the coins counted by the counting unit correctly matches with a specified rate of toll, and displacing means for displacing the coins in the second temporary coin holding means into a safe when a processing for the preceding vehicle is completed.

According to the present invention, the coins which have been recognized as true coins in the coin selector are introduced into the passage via the guiding course, whereby the coins are arranged in the passage side by side so as to allow them to be visually confirmed by the driver while they are temporarily held in the passage. Thereafter, by rotating the partition leading to the guiding course, e.g., a rod-shaped elongated plate by, e.g., a rotary solenoid, the coins arranged on the partition fall down onto a partition for the second temporary coin holding means. Finally, the coins in the second temporary coin holding means are displaced into the safe by actuating the partition for the second temporary coin holding means.

With the apparatus as constructed in the above-described manner, coins thrown by a driver can visually be recognized by him in an order of the coins processed in the coin separator while they are arranged side by side in the first temporary coin holding means. Consequently, the driver seating on his seat in the vehicle can easily confirm the coins which have been thrown by himself. An operation of receiving coins from a next driver can be undertaken at the same time when the coins held in the first temporary coin holding means fall down onto the partition of the second temporary coin holding means by rotating the rotary solenoid. Incidentally, the partition of the second temporary coin holding means is spaced away from the partition of the first temporary coin holding means by a distance substantially equal to 1.2 to 1.4 times as long as the maximum diameter of coins among the coins to be processed. Accordingly, an operation of the apparatus for a next driver can be started quickly, and an improved service and a reduced period of time required for a processing are assured.

Other objects, features and advantages of the present invention will be readily apparent from reading of the following description which has been made with reference to the accompanying drawings.

DETAILED DESCRIPTION OF THE PREFERRED EMBODIMENT

Now, the present invention will be described in detail hereinafter with reference to the accompanying drawings which illustrate a preferred embodiment thereof.

Figure 1:
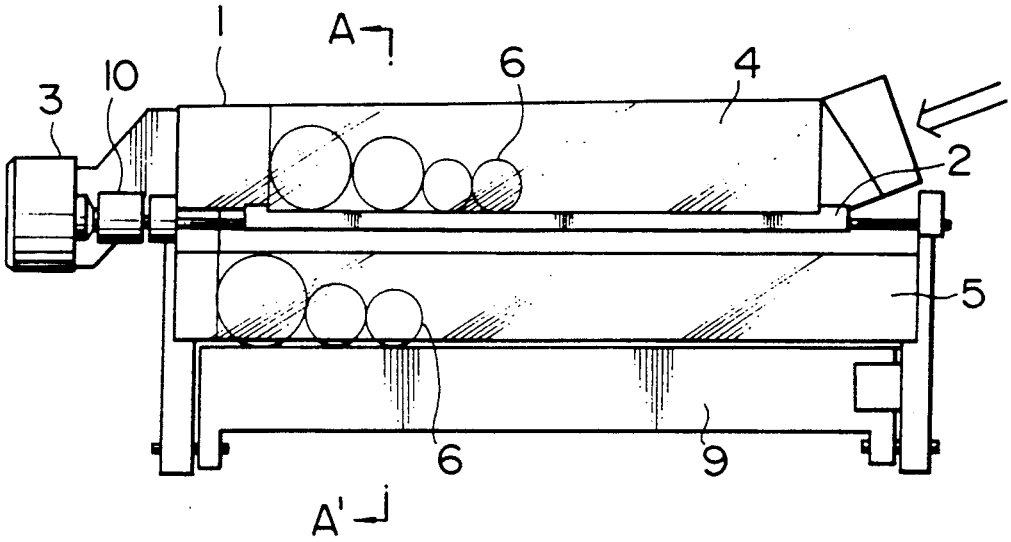
FIG. 1(A) is an explanatory view which illustrates a temporary holding mechanism usable for an automatic toll receiving apparatus in accordance with an embodiment of the present invention.
FIG. 1(B) is a sectional view of the temporary holding mechanism taken in line A—A' in FIG. 1(A).
Figure 1:
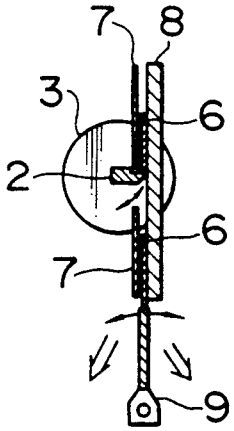
Figure 2B:
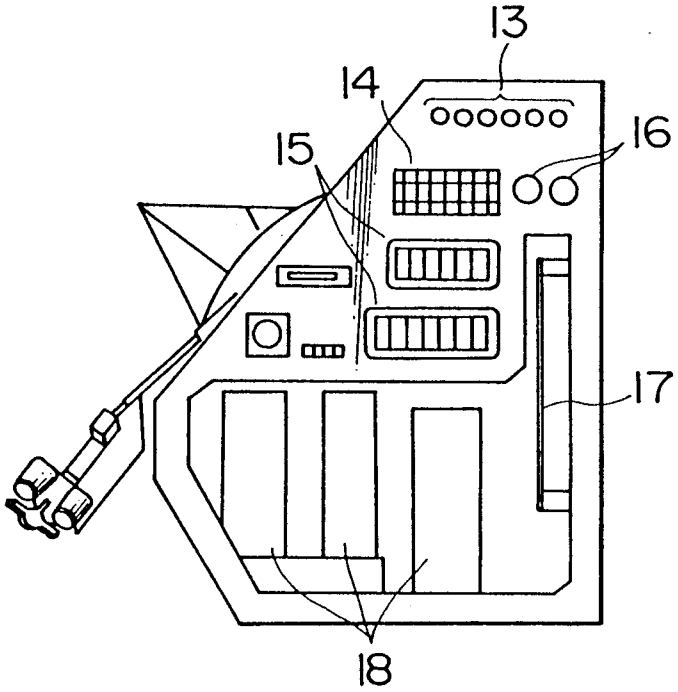
FIG. 2 shows a perspective view and a side view of a coin selector employable for the apparatus of the invention.
Figure 2A:
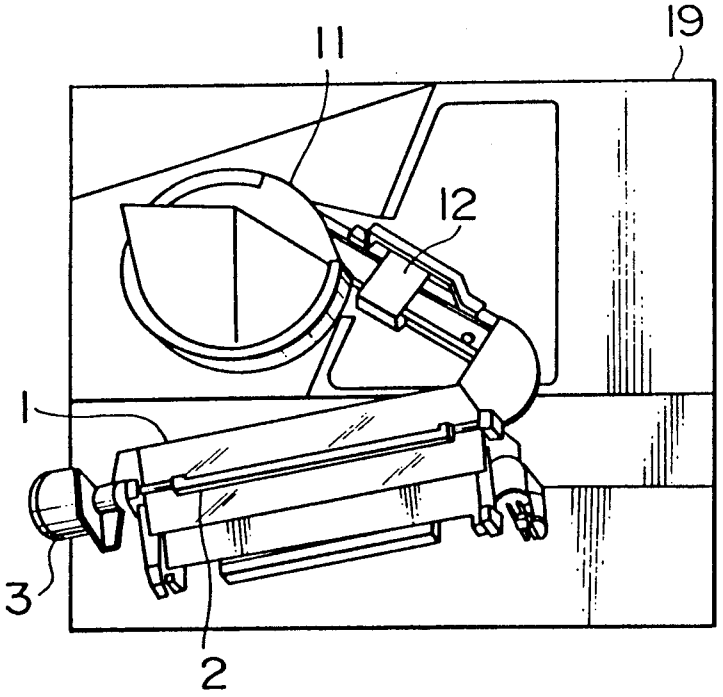
Figure 3A:
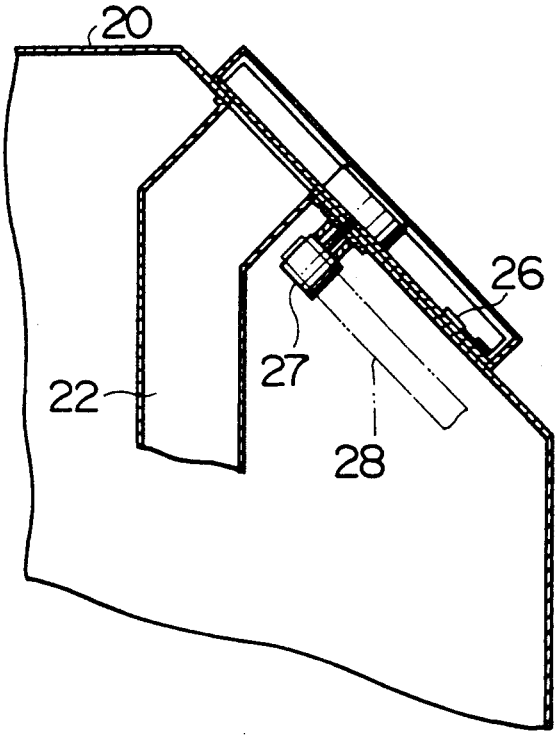
FIG. 3(A) PRIOR ART
FIG. 3 shows the structure of a conventional divisional rotary disc type temporary coin holding mechanism.
Figure 3B:
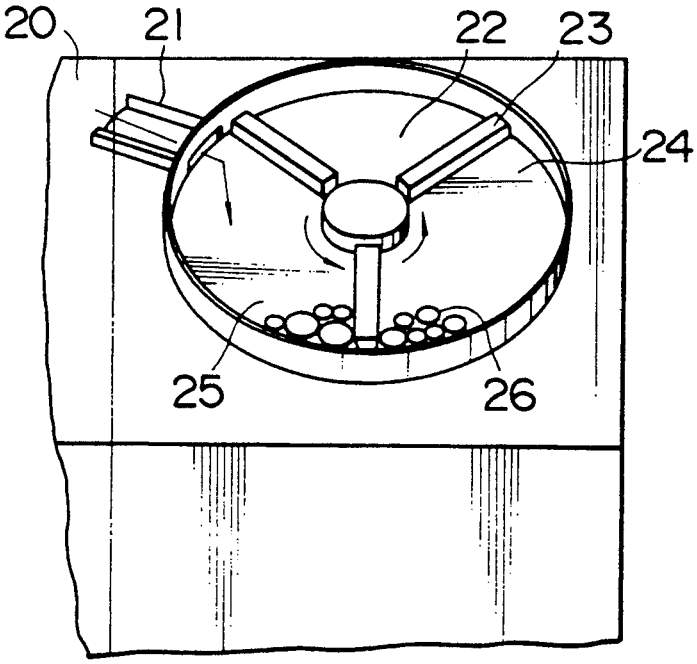
FIG. 3(B) PRIOR ART
Figure 4:
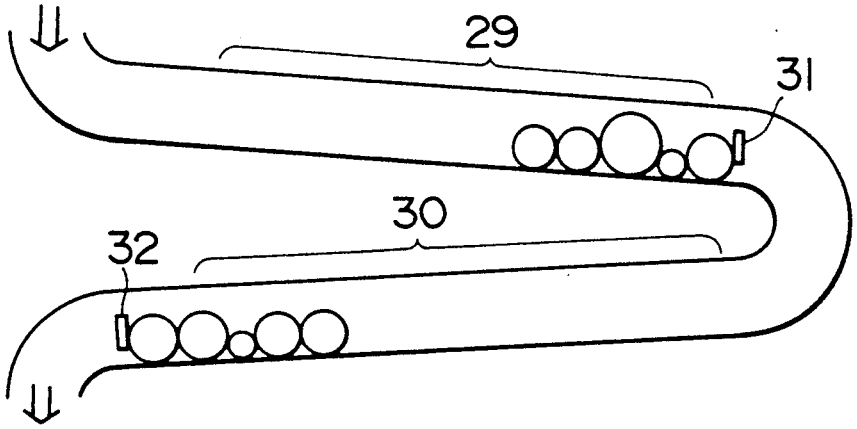
FIG. 4 PRIOR ART
FIG. 4 is a schematic view illustrating a conventional snake-shaped passage type temporary coil holding mechanism.

FIG. 1 is an explanatory view which schematically illustrates the structure of a temporary holding mechanism for an automatic toll receiving apparatus in accordance with the embodiment of the present invention. FIG. 2 is an explanatory view which illustrates a coin selector for the apparatus in accordance with the embodiment of the present invention.

In FIGS. 1 and 2, reference numeral 1 designates a housing of the temporary coin holding mechanism, reference numeral 2 designates a partition, reference numeral 3 designates a rotary solenoid, reference numeral 4 designates a first coin holding portion for which a processing is being performed for the present vehicle, reference numeral 5 designates a second coin holding portion for which a processing has been performed for the preceding vehicle, reference numeral 6 designates a plurality of coins which have been held, reference numeral 7 designates a transparent plate, reference numeral 8 designates a back plate for the temporary coin holding mechanism, reference numeral 9 designates a partition of which direction can be changed, reference numeral 10 designates a joint, reference numeral 11 designates a coin transferring mechanism, reference numeral 12 designates a coin discriminating/counting sensor, reference numeral 13 designates a plurality of display lamps, reference numeral 14 designates a plurality of input value setting switches, reference numeral 15 designates a plurality of characteristic value displays, reference numeral 16 designates a plurality of switches, reference numeral 17 designates a coin selector controlling board, reference numeral 18 designates a plurality of drivers and reference numeral 19 designates a housing of the coin selector.

Figure 6:
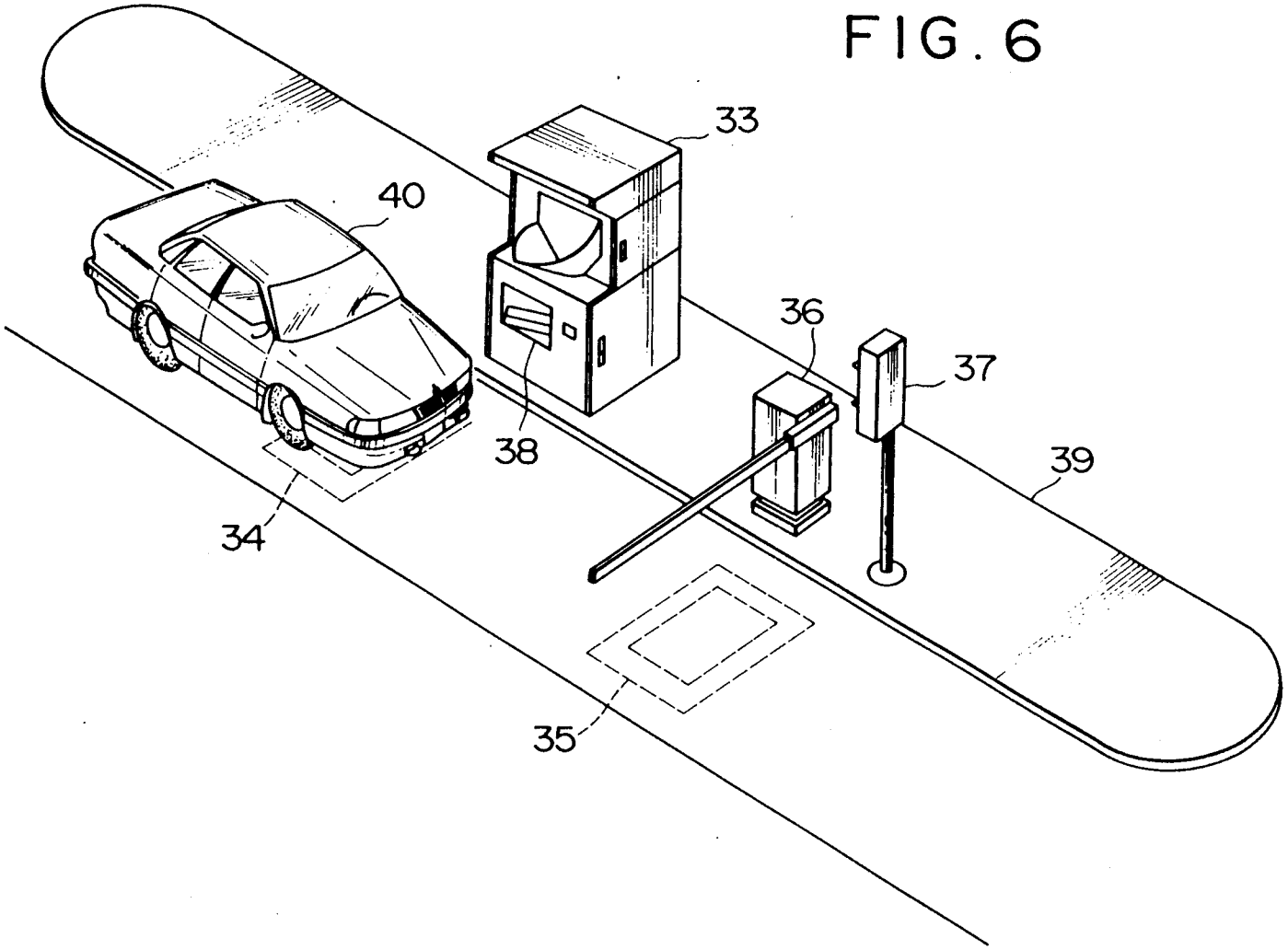
FIG. 6 is a perspective view illustrating an automatic toll receiving system in accordance with the present invention.

Next, description will be made below as to a case where the embodiment of the present invention is applied to an automatic toll receiving system for a toll highway as shown in FIG. 6.

Referring to FIG. 6, the automatic toll receiving system is composed of an automatic toll receiving apparatus 33 installed on a toll receiving island 39, a crossing gate 36, a signal generating guide lamp 37, a vehicle entrance detector 34 and a vehicle start detector 35. The vehicle entrance detector 34 and the vehicle start detector 35 are burried in the ground.

Figure 5:
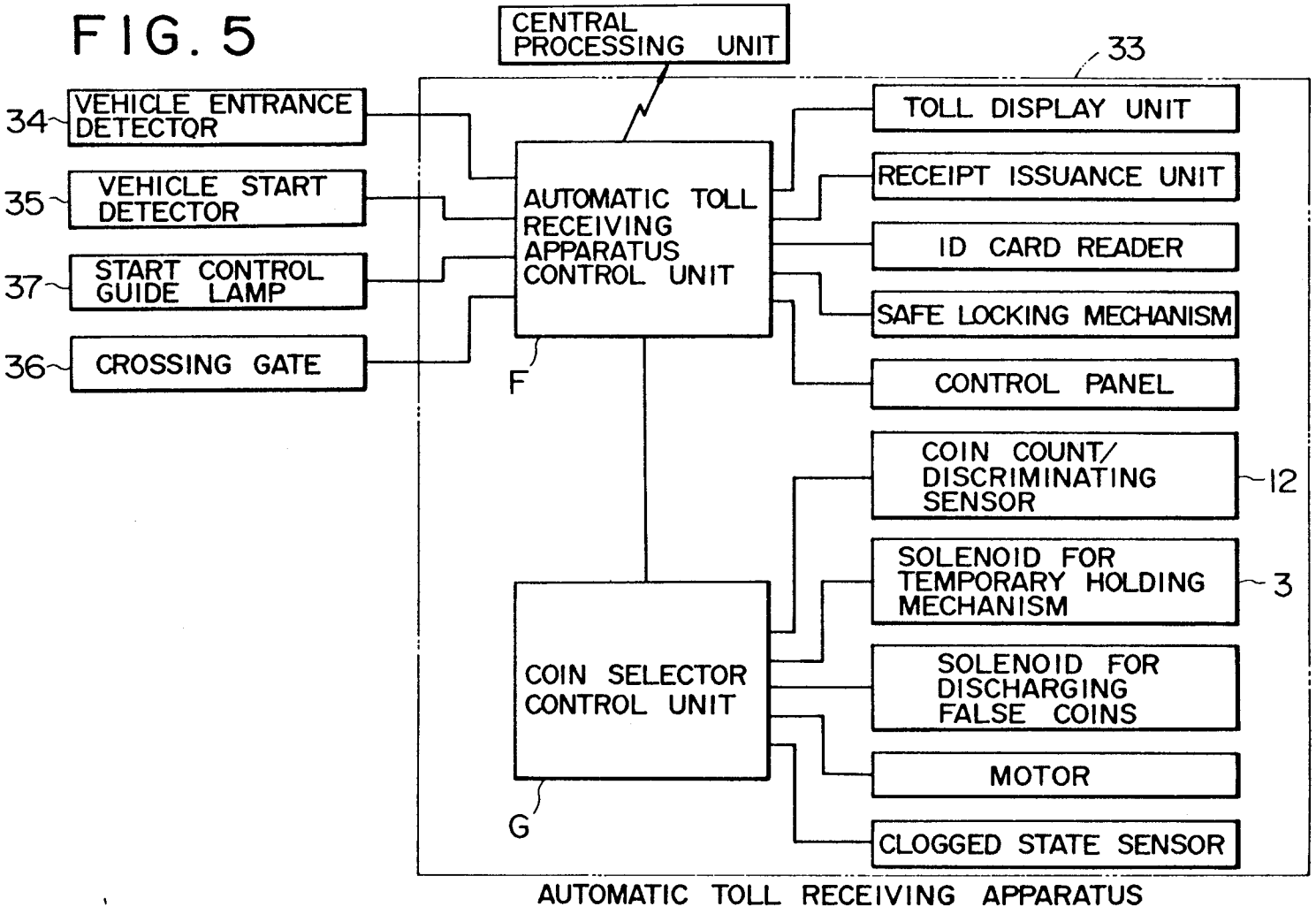
FIG. 5 is a block diagram illustrating a control system for the automatic toll receiving apparatus in accordance with the embodiment of the present invention.

First, approach of a vehicle 40 to the automatic toll receiving apparatus 33 is detected by the vehicle entrance detector 34. As is apparent from a block diagram in FIG. 5, a signal indicative of the entrance of the vehicle 40 is received by an automatic toll receiving apparatus controlling unit F, whereby the system is ready to receive a specified rate of toll to be thrown by a driver on the vehicle 40.

As shown in FIG. 2, the coins which have been thrown by drivers are introduced into a coin discriminating sensor 12 one by one via on the coin transferring mechanism 11 on the coin selector 11. Coins recognized as true coins in a coin selector controlling unit G are introduced into the temporary coin holding mechanism 1. On the other hand, false coins are displaced to another course and then brought back to the front side of the automatic toll receiving apparatus 33 so as to allow them to be returned to respective drivers.

As shown in FIG. 1, true coins are held in the first coin holding portion 4 for the present vehicle. Here, a clearance between the temporary coin holding mechanism housing 8 and the transparent plate 7 (made of acrylic resin, reinforced glass or the like material) is defined by the partition 2. A driver on the vehicle can visually recognize these temporarily held coins 6 through a temporary coin holding window 38 on the front side of the automatic toll receiving apparatus 33. This arrangement allows the driver to visually confirm a value of the thrown coin not only via the toll display unit but also by looking at his thrown coins, whereby an occurrence of trouble due to erroneous confirmation of the value of the thrown coin can be prevented.

The thrown coin is successively processed, and when it is confirmed that a value of the thrown coin correctly matches with a specified rate of toll, the crossing gate 36 located in front of the vehicle is opened, causing illumination of the start control guide lamp 37 to be shifted from red to blue. Thus, start of the vehicle is promoted. When start of the vehicle and completion of the start are detected by the vehicle start detecting unit 36, the crossing gate 36 is closed and illumination of the start control guide lamp 37 is shifted from blue to red. At the same time, operation of the coin selecting/transferring mechanism 11 is stopped. This causes receiving of thrown coins to be terminated.

When a next vehicle is detected by the vehicle detector 34, the coins held in the second coin holding portion 5 for the preceding vehicle fall down into a safe by turning the partition 9. Thereafter, the rotary solenoid 3 is rotated by an angle of about 45 degrees so that the coins placed on the partition 2 are displaced to the second coin holding portion 5 for the preceding vehicle. This allows the second coin holding portion 5 for the preceding vehicle to be emptied and at the same time the coin selecting/transferring mechanism 11 is activated. Now, coins thrown by a driver on a next vehicle are ready to be received.

The above-described cycle is repeated.

When the number of coins in excess of a capacity of the first coin holding portion 4 of the temporary coin holding mechanism are to be processed at a time, the following steps of operations may be performed. Specifically, an operation of the coin transferring mechanism 11 is once stopped at the time when a predetermined number of coils have been processed so that the coins are displaced to the first coin holding portion 4 or the second coin holding portion 5 of the temporary holding mechanism by one step (i.e., the coins in the second coin holding portion 5 are displaced into the safe, the first coin holding portion 4 are displaced to the second coin holding portion 5 and the first coin holding portion 4 is emptied). Then, a processing can be started again.

As will be apparent from the above description, coins held in the temporary coin holding mechanism do not overlap each other but they can visually be recognized while they are arranged side by side in an order of processed coins. Thus, the apparatus of the present invention provides excellent visual confirmation with received coins. Moreover, to receive coins thrown from a next vehicle, transference and displacement of the coins into the apparatus can be achieved quickly and exactly. Consequently, a period of time required for receiving of the coins can be shortened substantially.

We claim:

1. In a automatic toll receiving apparatus including a large hopper into which coins are thrown by a driver sitting on a seat in an automotive vehicle, coin selecting means for determining whether the thrown coins are true coins or false coins and discriminating means for discriminating different types of coins, counting means following said selecting means for counting a value of the coins which are determined as true coins by said selecting means, returning means for returning to the driver the coins which are determined as false coins by said coin selecting means and temporary coin holding means for temporarily holding the received coins, the improvement wherein;

said temporary coin holding means comprises a first coin holding portion for a present vehicle and a second coin holding portion for a preceding vehicle, said second coin holding portion being located below said first coin holding means, the first coin holding portion and the second coin holding portion comprising an inclined passage, respectively, of which width and height are dimensioned equal to a thickness and a diameter of a largest coin among a number of coins passing therethrough, a side wall of said passage is made of transparent material so as to allow coins held in the passage to be visually confirmed from outside of said passage, the first coin holding portion includes a bottom which comprises a rod-shaped elongated partition adapted to be displaced in a direction transverse to the passage so that on displacement of said partition the coins in the first coin holding portion fall down into the second coin holding portion, and the second coin holding portion includes a bottom which comprises a rod-shaped elongated partition adapted to be displaced in the transverse direction of the passage so that on displacement of said partition the coins in the second coin holding portion fall down into a safe.

2. The apparatus as claimed in claim 1, wherein the partition of the first coin holding portion is rotationally driven by a rotary solenoid.

* * * * *